US011107389B2

(12) United States Patent
Kim

(10) Patent No.: US 11,107,389 B2
(45) Date of Patent: Aug. 31, 2021

(54) DATA DRIVING APPARATUS FOR DISPLAY AND DRIVER THEREOF

(71) Applicant: SILICON WORKS CO., LTD., Daejeon-si (KR)

(72) Inventor: Young Gi Kim, Daejeon (KR)

(73) Assignee: Silicon Works Co., Ltd., Daejeon-si (KR)

( * ) Notice: Subject to any disclaimer, the term of this patent is extended or adjusted under 35 U.S.C. 154(b) by 26 days.

(21) Appl. No.: 16/223,730

(22) Filed: Dec. 18, 2018

(65) Prior Publication Data

US 2019/0197942 A1 Jun. 27, 2019

(51) Int. Cl.

| | |
|---|---|
| ***G09G 3/32*** | (2016.01) |
| ***G09G 3/20*** | (2006.01) |
| ***G09G 3/36*** | (2006.01) |

(52) U.S. Cl.

CPC ..... *G09G 3/2096* (2013.01); *G09G 3/32* (2013.01); *G09G 3/3685* (2013.01); *G09G 2310/0289* (2013.01); *G09G 2330/026* (2013.01); *G09G 2370/04* (2013.01)

(58) Field of Classification Search

CPC ..... G09G 3/2096; G09G 3/32; G09G 3/3277; G09G 3/323283; G09G 3/3291; G09G 3/3685; G09G 3/3688; G09G 3/3692; G09G 3/36; G09G 3/3275; G09G 3/32383

See application file for complete search history.

(56) References Cited

U.S. PATENT DOCUMENTS

| | | | | |
|---|---|---|---|---|
| 2012/0086681 | A1* | 4/2012 | Kim | G09G 3/3648 345/204 |
| 2017/0132966 | A1* | 5/2017 | Lim | G09G 3/2092 |
| 2017/0200432 | A1* | 7/2017 | Hsu | G09G 5/006 |

FOREIGN PATENT DOCUMENTS

| | | |
|---|---|---|
| KR | 10-1309371 | 9/2013 |
| KR | 10-2013-0117133 | 10/2013 |
| KR | 10-1717721 | 3/2017 |
| KR | 10-1784522 | 10/2017 |

* cited by examiner

*Primary Examiner* — Vijay Shankar
*Assistant Examiner* — Cory A Almeida
(74) *Attorney, Agent, or Firm* — Polsinelli PC

(57) ABSTRACT

Disclosed is a data driving apparatus for a display device, which controls drivers to share operation data stored in a memory. The data driving apparatus can improve a routing environment of an EEPROM on an FPCB, thereby simplifying a process of transferring operation data to the drivers and reducing the time required for a reset mode.

13 Claims, 5 Drawing Sheets

DATA DRIVING APPARATUS FOR DISPLAY AND DRIVER THEREOF

BACKGROUND

1. Technical Field

The present disclosure relates to a display, and more particularly, to a data driving apparatus for a display device, which controls drivers to share operation data stored in a memory.

2. Related Art

A liquid crystal display (LCD) device using a liquid crystal element as a light source or a light emitting diode (LED) device using an LED as a light source includes a driver which drives source signals in response to display data and provides the source signals to a display panel.

The driver is manufactured as a semiconductor package. When the driver is mounted through a chip-on-glass method, the driver may be mounted on glass of the display panel. When the driver is mounted through a chip-on-film method, the driver may be mounted on a flexible printed circuit board (FPCB). In general, a plurality of drivers are configured for one display panel, and the number of drivers is decided according to the size and resolution of the display panel.

The driver may be designed to have a timing controller embedded therein, if necessary. Furthermore, the driver may be designed to receive data such as a command from outside, the command being required for powering on the display device or driving display data.

The data such as the command is typically stored in a memory such as an electrically erasable programmable read-only memory (EEPROM). The EEPROM is mounted on the FPCB, and shared by a plurality of drivers through routing lines. The FPCB may have a power supply device mounted thereon, as well as the EEPROM. Also, the FPCB includes routing lines for transferring control signals to the display panel, the control signals including power, data and an option signal.

The data stored in the EEPROM need to be transferred to the plurality of drivers in a reset mode at the initial stage of the power-on sequence. During a normal operation in which the plurality of drivers output source signals, the data stored in the EEPROM need to be transferred to the plurality of drivers, if necessary.

The recent trend is to develop display panels to have a large screen and high image quality. Thus, the process of transferring data of the EEPROM to the plurality of drivers needs to be simplified, and the time required for transferring data needs to be reduced.

SUMMARY

Various embodiments are directed to a data driving apparatus for a display device, which can simplify a process of transferring operation data stored in an EEPROM serving as a memory in a display device to a plurality of drivers.

Also, various embodiments are directed to a data driving apparatus for a display device, which can reduce the time required for transferring operation data stored in an EEPROM serving as a memory to a plurality of drivers.

In an embodiment, a data driving apparatus for a display device may include: a memory configured to store operation data, and provide the operation data through a routing line; a first driver coupled to the memory through the routing line, and configured to provide a first read command to the memory and receive the operation data provided in response to the first read command, in a first operation period; and a second driver configured to share the memory with the first driver through the routing line, and receive the operation data shared through the routing line in the first operation period.

In an embodiment, a data driving apparatus for a display device may include: a memory configured to store operation data, and provide the operation data through a routing line; a first driver coupled to the memory through the routing line, and configured to provide a first read command to the memory and receive the operation data provided in response to the first read command, in a first operation period; one or more second drivers configured to share the memory with the first driver through the routing line, and receive the operation data shared through the routing line in the first operation period; and a request line shared by the first driver and the one or more second drivers, wherein the first driver and the one or more second drivers generate a request command when a fail occurred in the received operation data, and share the request command with the request line, the first driver provides a second read command to the memory in response to the request command, and the driver having generated the request command, among the first driver and the one or more second drivers, receives the operation data corresponding to the second read command.

In an embodiment, a driver of a data driving apparatus for a display device may include: a checksum determination unit configured to share operation data of a memory with one or more other drivers through a routing line, receive the operation data through the routing line in a first operation period, and provide a determination signal indicating a result obtained by determining a fail of the operation data; and a request driving circuit configured to generate a request command in response to the determination signal, and drive the request command to a request line shared with the one or more other drivers, wherein the driver receives the operation data shared by the routing line in response to the request command in a second operation period following the first operation period.

DETAILED DESCRIPTION

Figure 1:
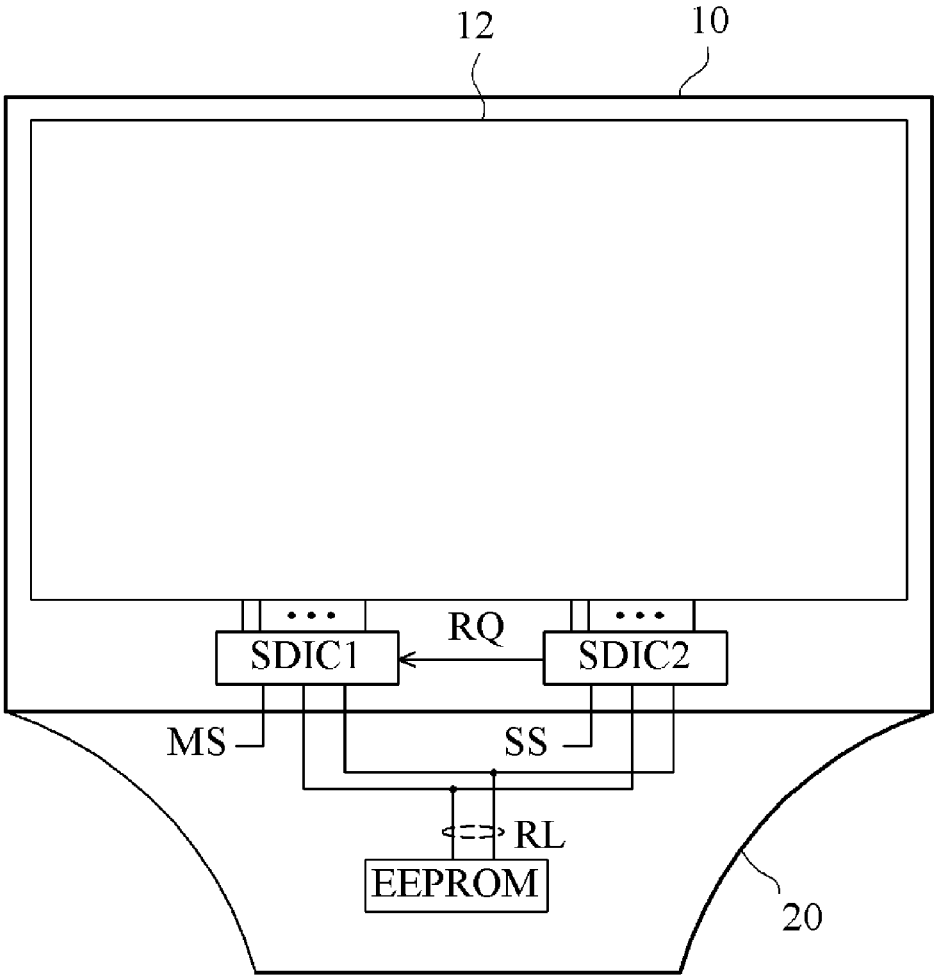
FIG. 1 is a block diagram illustrating a data driving apparatus for a display device in accordance with an embodiment of the present invention.

Hereafter, embodiments of the present invention will be described in detail with reference to the accompanying drawings. The terms used in this specification and claims are not limited to typical dictionary definitions, but should be interpreted as meanings and concepts which coincide with the technical idea of the present invention.

Embodiments described in this specification and configurations illustrated in the drawings are preferred embodiments of the present invention, and do not represent the entire technical idea of the present invention. Thus, various equivalents and modifications capable of replacing the embodiments and configurations may be provided at the time that the present application is filed.

A display device to which a data driving apparatus in accordance with an embodiment of the present invention is applied may be understood as a flat panel display device including pixels configured as light emitting diodes (LEDs) or a liquid crystal display (LCD).

The data driving apparatus for a display device in accordance with the embodiment of the present invention may be configured as illustrated in FIG. 1.

Referring to FIG. 1, the data driving apparatus in accordance with the embodiment of the present invention includes a display panel 10 and an FPCB 20, and has a structure in which the FPCB 20 is bonded to one side of the display panel 10.

The display panel 10 is manufactured in a rectangular shape by using glass as a substrate, and includes pixels formed in a preset rectangular display region 12. The display region 12 serves to display an image by driving the pixels.

Between one side of the display region 12 and one side of the display panel 10, to which the FPCB 20 is attached, a space for bonding drivers SDIC1 and SDIC2 is formed. FIG. 1 illustrates that two drivers SDIC1 and SDIC2 are bonded.

Unlike the structure of FIG. 1, the drivers SDIC1 and SDIC2 may be mounted on the FPCB through a chip-on-film method. The embodiment of the present invention is based on the supposition that the drivers SDIC1 and SDIC2 are mounted through the chip-on-glass method as illustrated in FIG. 1, for convenience of description.

The two drivers SDIC1 and SDIC2 in accordance with the embodiment of FIG. 1 may be configured as any one of a semiconductor device including a source driver and a semiconductor device including a source driver and a timing controller.

The source drivers SDIC1 and SDIC2 are bonded on glass of the bonding space formed at the one side of the display region 12 of the display panel 10 through a chip-on-glass method.

The drivers SDIC1 and SDIC2 have input pads and output pads formed on bonding surfaces thereof.

The output pads of the drivers SDIC1 and SDIC2 form channels for outputting source signals. The output pads of the drivers SDIC1 and SDIC2 are electrically coupled to output lines on the glass through bonding. That is, the drivers SDIC1 and SDIC2 are configured to provide the source signals to the display region 12 of the display panel 10 through the output lines.

The input pads of the drivers SDIC1 and SDIC2 form channels for inputting power, display data, option signals MS and SS and operation data, which are provided from outside. The input pads of the drivers SDIC1 and SDIC2 are electrically coupled to routing lines on the glass through bonding. FIG. 1 illustrates the routing line RL for inputting the option signals MS and SS and the routing lines RL for inputting the operation data, among the routing lines.

The driver SDIC1 is set to a master driver according to the option signal MS, and the driver SDIC2 is set to a slave driver according to the option signal SS. The driver SDIC1 is configured to provide a read command to the EEPROM which is mounted as a memory on the FPCB 20 to be described below, through the routing lines RL. The drivers SDIC1 and SDIC2 are configured to provide operation data of the EEPROM through the routing lines RL.

The option signals MS and SS may be provided from the outside of the drivers SDIC1 and SDIC2, and applied as preset values for recognizing the drivers SDIC1 and SDIC2 as the master and slave drivers, the values being set by a designer.

The driver SDIC1 is configured to receive a request command RQ from the driver SDIC2.

The FPCB 20 includes routing lines for inputting the power, the display data, the option signal MS and the operation data, which are to be provided to the drivers SDIC1 and SDIC2. As illustrated in FIG. 1, the EERPOM may be mounted as a memory on the FPCB 20. Although not illustrated, a power management integrated circuit (PMIC) and the like may be mounted on the FPCB 20.

The EEPROM is an example of a semiconductor chip for providing operation data. The operation data may be provided by various devices. For example, when a timing controller is not included in the drivers SDIC1 and SDIC2, the timing controller may be mounted on the FPCB 20 to provide the operation data by utilizing an internal memory thereof.

In the present embodiment, the operation data of the EEPROM include data such as commands for setting operations or modes of the respective units of the drivers SDIC1 and SDIC2. For example, when the display device is powered on, the drivers SDIC1 and SDIC2 perform a reset mode in response to the power-on. The reset mode may indicate an operation of canceling a reset. Hereafter, the reset mode in accordance with the embodiment of the present invention may be understood as a reset cancellation operation. At this time, a command for the reset mode may be provided to the drivers SDIC1 and SDIC2 from the EERPOM according to a read command of the driver SDIC1. The command may be included in the operation data, and provided to the drivers SDIC1 and SDIC2.

FIG. 1 representatively illustrates the routing lines RL for transferring the option signal MS or SS and the routing lines RL for transferring the operation data, among the routing lines. In FIG. 1, the illustration of routing lines for transferring power and display data is omitted.

The FPCB 20 is connected to one side of the display panel 10, to which the drivers SDIC1 and SDIC2 are bonded, and the routing lines of the FPCB 20 and the routing lines formed on the glass of the display panel 10 are electrically coupled through the connection between the FPCB 20 and the display panel 10. That is, the routing lines of the FPCB 20 are electrically coupled to the input pads of the drivers SDIC1 and SDIC2 through the routing lines of the display panel 10. Hereafter, it may be understood that the routing lines in accordance with the embodiment of the present invention are formed through the chip-on-glass method. Furthermore, when the positions of the routing lines are not defined, the routing lines may include the routing lines of the FPCB 20 and the routing lines formed on the glass of the display panel 10, which are electrically coupled to each other. Unlike the present embodiment, the drivers SDIC1 and SDIC2 may be mounted through the chip-on-film method. According to the chip-on-film method, it may be understood that the routing lines are connected between the EEPROM on the FPCB 20 and the drivers SDIC1 and SDIC2.

In the embodiment of FIG. 1, the drivers SDIC1 and SDIC2 are configured to share the EEPROM through the routing lines RL.

The drivers SDIC1 and SDIC2 may perform an operation of driving display data as source signals and providing the source signals to the pixels of the display region 12, an operation of processing the option signal MS or SS, and an operation of receiving and processing the operation data.

First, in order to drive the display data as the source signals, the drivers SDIC1 and SDIC2 may include a clock-data recovery circuit, latches, shift registers, digital-analog converters and output buffers, which are not illustrated in the drawing.

The display data may be transferred through a protocol having a clock embedded in data, for example. The clock-data recovery circuit recovers a clock signal corresponding to the clock for display data transferred through the protocol, and recovers data using the clock signal. The latches latch the data to align the data by a predetermined amount, and the shift registers convert the latched data into a level for analog-converting. The digital-analog converters generate analog outputs corresponding to the data transferred from the shift registers. The output buffers output the outputs of the analog-digital converters as source signals to the pixels of the display region 12.

The drivers SDIC1 and SDIC2 receive the option signal MS or SS, and are to the master or slave driver in response to the option signal MS or SS.

The driver SDIC1 is set to the master driver according to the option signal MS, and configured to provide a read command to the EEPROM through the routing lines RL in a first operation period Top1, and receive the operation data provided from the EEPROM through the routing lines RL in response to the read command in the first operation period Top1.

The driver SDIC2 is set to the slave driver according to the option signal SS, and configured to share the EEPROM with the driver SDIC1 through the routing lines RL, and receive the operation data shared by the routing lines RL in the first operation period Top1.

Figure 2:
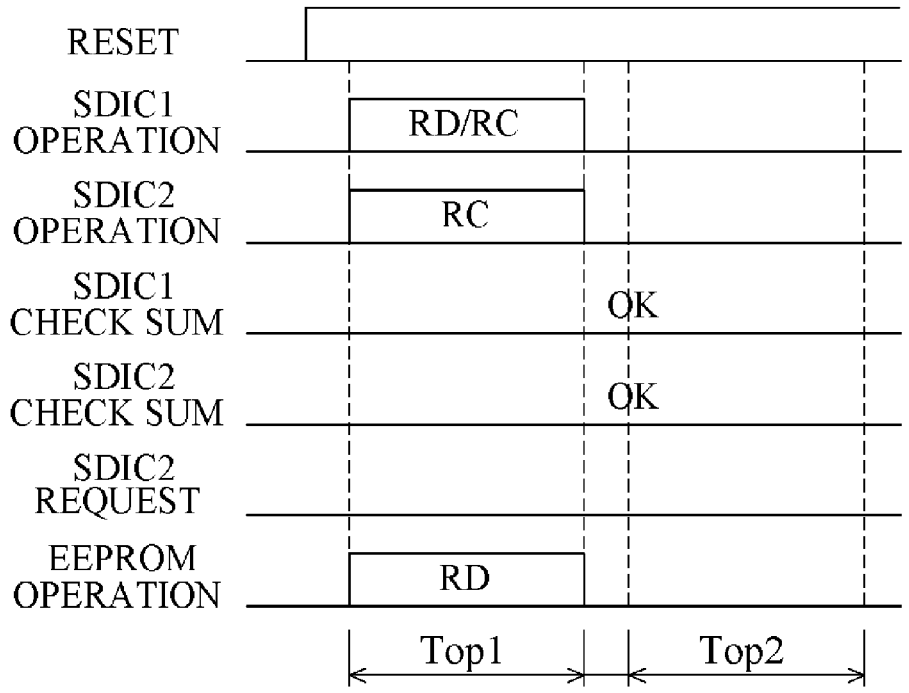
FIG. 2 is a timing diagram for describing an operation of the data driving apparatus in accordance with the embodiment of FIG. 1.

That is, as illustrated in FIG. 2, the drivers SDIC1 and SDIC2 may read and receive the operation data in the first operation period Top1.

Referring to FIG. 2, the drivers SDIC1 and SDIC2 perform the reset mode in response to power-on of the display device, and require the operation data such as a command for the reset mode for a display operation.

The driver SDIC1 set to the master driver provides a first read command to the EEPROM through the routing lines RL in response to reset cancellation in the first operation period Top1 (RD).

The EEPROM provides the operation data to the routing lines RL in response to the first read command of the driver SDIC1. That is, the operation data are shared by the drivers SDIC1 and SDIC2 through the routing lines RL.

When the operation data are shared through the routing lines RL in the first operation period Top1, the drivers SDIC1 and SDIC2 receive the operation data through the routing lines RL (RC).

The driver SDIC1 receives the operation data corresponding to the first read command, after providing the first read command. However, the driver SDIC2 waits for the operation data to be shared through the routing lines RL in the rest mode, and receives the operation data when the operation data are shared by the routing lines RL.

As described above, the operation periods Top1 and Top2 illustrated in FIG. 2 may be set on a horizontal period or frame period basis.

The drivers SDIC1 and SDIC2 may complete the transferring (RD) of the read command and the receiving (RC) of the operation data in the one-cycle operation period Top1, and then additionally perform an operation corresponding to the command of the operation data.

As described above, the operation data can be transferred to the plurality of drivers within a one-cycle operation period, and the time required for transferring the operation data can be reduced through the simple process.

The drivers SDIC1 and SDIC2 may check whether a fail occurred in the received operation data. For this operation, the drivers SDIC1 and SDIC2 may include a checksum determination unit (not illustrated) which will be described below. The checksum determination unit may be configured to use various checksum methods capable of determining a fail based on a result obtained by performing an operation on the operation data, and the detailed descriptions thereof are omitted herein.

That is, when the checksum result indicates that a fail occurred in the operation data, the drivers SDIC1 and SDIC2 may perform an operation for receiving the operation data again.

Figure 3:
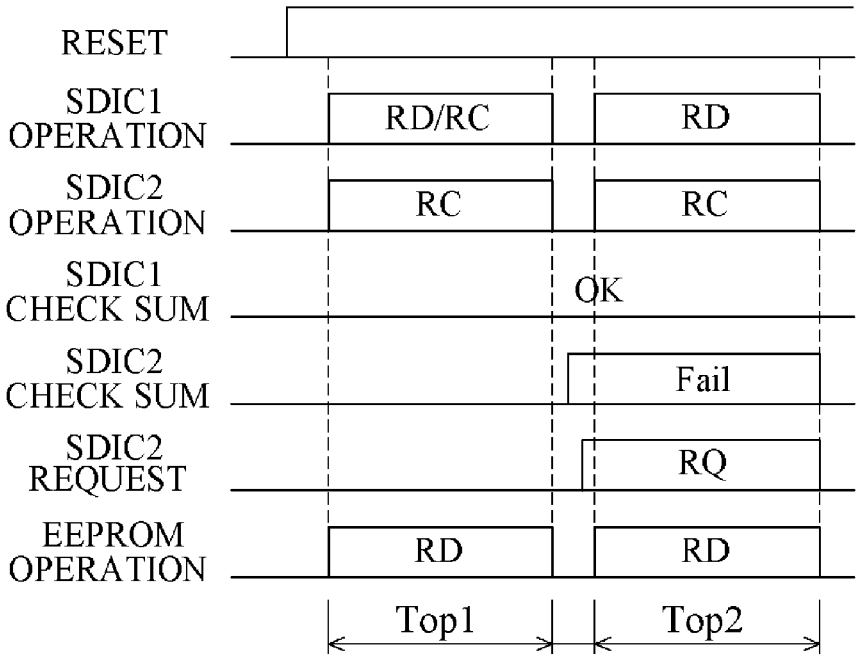
FIG. 3 is a timing diagram for describing an operation of the data driving apparatus in accordance with the embodiment of FIG. 1 when a fail occurred.

FIG. 3 is a waveform diagram for describing an operation when the checksum result of the driver SDIC2 indicates that a fail of the operation data occurred. Since the operations of the drivers SDIC1 and SDIC2, corresponding to the first operation period Top1 of FIG. 3, are performed in the same manner as those of FIG. 2, the duplicated descriptions thereof will be omitted herein.

The drivers SDIC1 and SDIC2 determine whether a fail occurred in the operation data, by performing a checksum check on the operation data after the first operation period Top1.

When the checksum result indicates that a fail occurred in the operation data, the driver SDIC2 provides the request command RQ to the driver SDIC1 in the second operation period Top2 following the first operation period Top1. That is, the request command RQ of the driver SDIC2 may be provided according to the checksum result, after the first operation period Top1 is ended.

The driver SIDC1 receives the request command RQ, and provides a second read command to the EEPROM in response to the request command RQ in the second operation period Top2 (RD). The second read command may be understood as the same command as the first read command of the first operation period Top1, and only referred to as the different name to distinguish between the first and second read commands.

The EEPROM provides the same operation data as those corresponding to the first read command to the routing lines RL in response to the second read command.

When the operation data are shared through the routing lines RL in the second operation period Top2, the driver SDIC2 receives the operation data through the routing lines RL again (RC).

At this time, the driver SDIC1 may be configured to receive the operation data corresponding to the second read command again or ignore the operation data.

When the checksum result of the driver SDIC1 indicates that a data fail occurred, the driver SDIC1 provides the second command corresponding to its checksum result to the EEPROM, regardless of whether the request command of the driver SDIC2 is received.

That is, the driver SDIC1 provides the second read command to the EEPROM in the second operation period Top2 following the first operation period Top1, in order to remove the operation data fail.

Then, the EEPROM provides the same operation data as those corresponding to the first read command to the routing lines RL in response to the second read command.

When the operation data are shared through the routing lines RL in the second operation period Top2 as described above, the driver SDIC1 may receive the operation data through the routing lines RL again (RC).

At this time, the driver SDIC2 may be configured to receive the operation data corresponding to the second read command again or ignore the operation data.

That is, the driver DSIC1 may be configured to provide the second read command to the EEPROM in response to at least one of the case that a fail occurs in the operation data received by the driver DSIC1 and the case that the driver SDIC1 receives the request command RQ, in the second operation period Top2 following the first operation period Top1.

According to the above-described configuration, the drivers SDIC1 and SDIC2 may complete the transferring of the read command and the receiving of the operation data in the first operation period Top1, and then remove a fail of the operation data in the second operation period Top2.

As described above, the data driving apparatus in accordance with the embodiment of the present invention can transfer the operation data to the plurality of drivers and remove a fail of the operation data within the two operation periods. Furthermore, the data driving apparatus can reduce the time required for transferring the operation data through the simple process.

FIGS. 1 to 3 illustrate the operations of the drivers SDIC1 and SDIC2 when the reset mode corresponding to power-on is performed. However, the present invention may also be applied to a normal operation in which the drivers SDIC1 and SDIC2 output the source signals after performing the reset mode corresponding to the power-on sequence including the first and second operation periods Top1 and Top2. That is, when a fail of the operation data occurs while the normal operation is performed, the drivers SDIC1 and SDIC2 may perform the operation of providing the read command to the EEPROM as in FIGS. 1 to 3 again.

Figure 4:
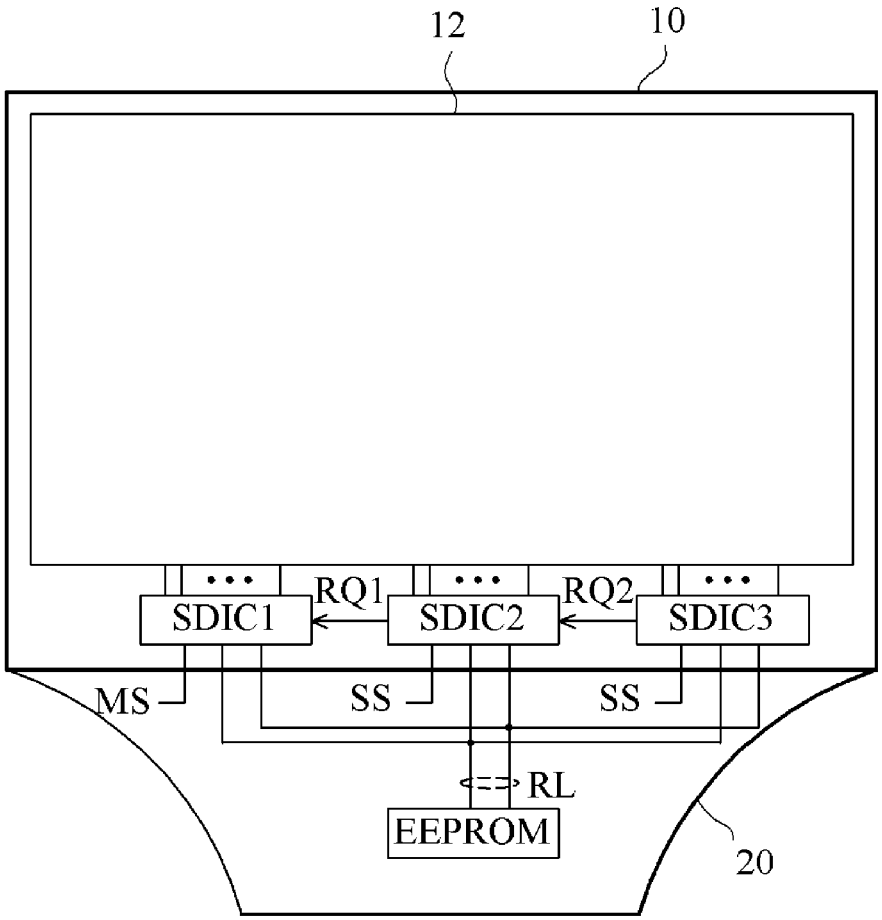
FIG. 4 is a block diagram illustrating a data driving apparatus for a display device in accordance with another embodiment of the present invention.

The present invention may be applied even when three drivers SDIC1 to SDIC3 are mounted on the display panel 10 as illustrated in FIG. 4.

Figure 5:
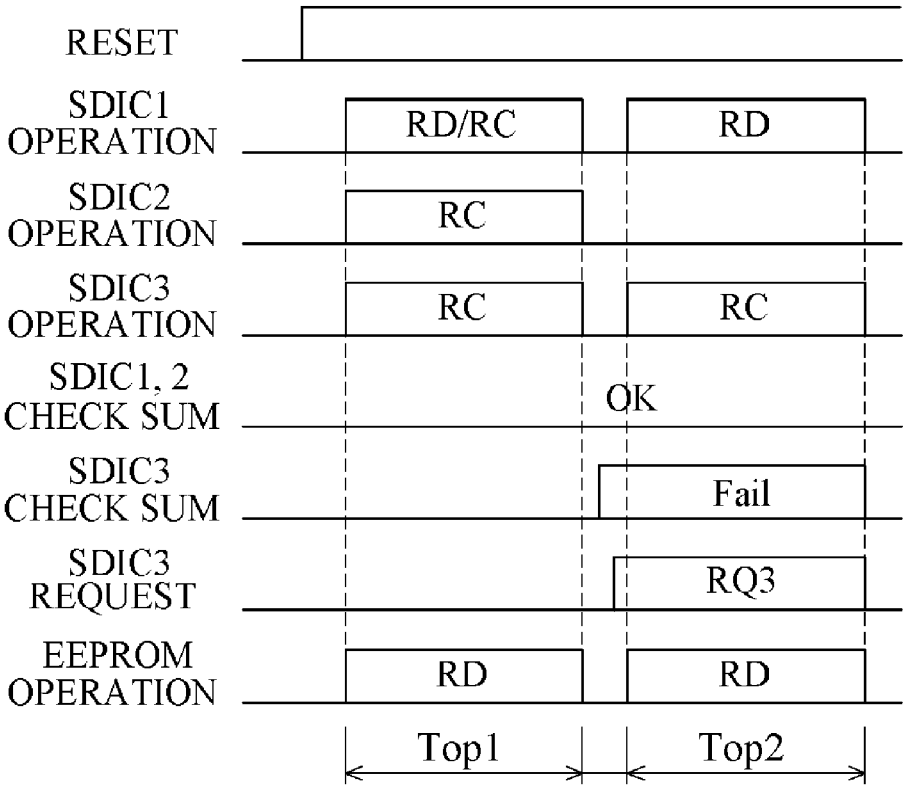
FIG. 5 is a timing diagram for describing an operation of the data driving apparatus in accordance with the embodiment of FIG. 4 when a fail occurred.

The data driving apparatus in accordance with the embodiment of FIG. 4 further includes a driver SDIC3 that shares the EEPROM with the drivers SDIC1 and SDIC2 through the routing lines RL, compared to the embodiment of FIG. 1. The driver SDIC3 is configured to provide a request command to the driver SDIC2. In the embodiment of FIGS. 4 and 5, the request command of the driver SDIC2 will be referred to as a first request command RQ1, and the request command of the driver SDIC3 will be referred to as a second request command RQ2.

The driver SDIC3 is also set to a slave driver like the driver SDIC2, and receives the operation data shared by the routing lines RL in the first operation period Top1, like the driver SDIC2.

Since the operations of the drivers SDIC1 and SDIC2 in the first operation period Top1 can be understood through the operations described with reference to FIGS. 1 and 2, the duplicated descriptions will be omitted herein.

Furthermore, since an operation of the driver SDIC3 in the first operation period Top1 is performed in the same manner as the operation of the driver SDIC2 described with reference to FIGS. 1 and 2, the duplicated descriptions will be omitted herein.

The driver SDIC3 in accordance with the embodiment of FIG. 4 performs an operation corresponding to the second operation period Top2 of FIG. 5, when a fail occurred in the received operation data.

The driver SDIC3 determines whether a data fail occurred, by performing a checksum check on the operation data after the first operation period Top1.

When the checksum result of the operation data indicates that a data fail occurred, the driver SDIC3 provides the second request command RQ2 to the driver SDIC2. That is, the request command of the driver SDIC3 may be provided according to the checksum result, after the first operation period Top1 is ended.

The driver SDIC2 provides the first request command RQ1 corresponding to the second request command RQ2 to the driver SDIC1.

The driver SIDC1 receives the first request command RQ1, and provides a second read command to the EEPROM in response to the first request command RQ1 in the second operation period Top2 following the first operation period Top1 (RD).

The EEPROM provides the operation data to the routing lines RL in response to the second read command.

When the operation data are shared through the routing lines RL in the second operation period Top2 as described above, the driver SDIC3 receives the operation data through the routing lines RL again (RC).

At this time, the drivers SDIC1 and SDIC2 may be configured to receive the operation data corresponding to the second read command again or ignore the operation data.

Figure 6:
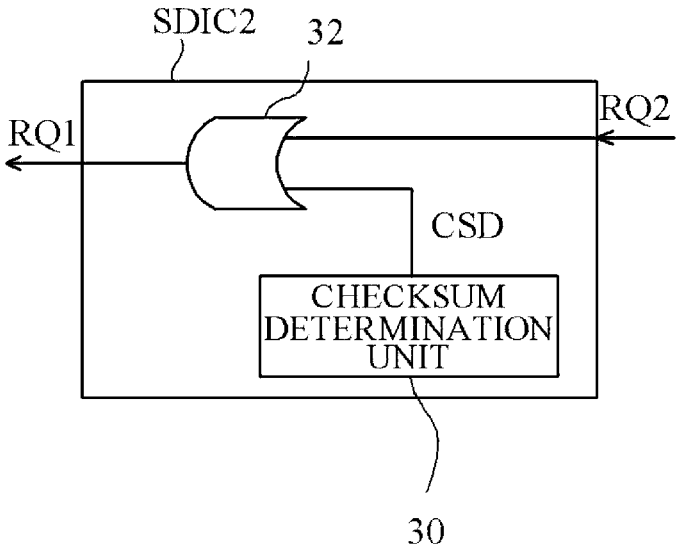
FIG. 6 is a diagram illustrating a circuit for transferring a request command within a driver.

For the operation of FIGS. 4 and 5, the driver SDIC2 may include a circuit for transferring a request command as illustrated in FIG. 6.

Referring to FIG. 6, the driver SDIC2 includes a checksum determination unit 30 and a logic circuit 32.

The checksum determination unit 30 is configured to have a checksum function for the operation data received by the driver SDIC2, and output a determination signal CSD indicating a result obtained by determining whether a fail occurred in the operation data.

The logic circuit 32 may be implemented as an OR circuit, and configured to perform an OR operation on the second request command RQ2 and the determination signal CSD and output the operation result as the first request command RQ1.

The driver SDIC2 may separately include an input terminal for receiving the second request command RQ2 and an output terminal for outputting the first request command RQ1. Alternatively, the driver SDIC2 may include input and output terminals which are configured to be shared with terminals for other purposes.

According to the above-described configuration, the driver SDIC2 may provide the first request command RQ1 corresponding to the fail of the operation data or the second request command RQ2 to the driver SDIC1. At this time, it may be understood that the second request command RQ2 actually bypasses the driver SDIC2 so as to be transferred to the driver SDIC1.

In the present embodiment, the drivers SDIC1 to SDIC3 may include the circuit illustrated in FIG. 6. The driver SDIC1 may be configured to generate a read command based on the output of the logic circuit 32, and the driver SDIC3 may be configured in such a manner that one terminal of the logic circuit 32 receiving the request command from outside has a preset value (for example, logic low level).

Figure 7:
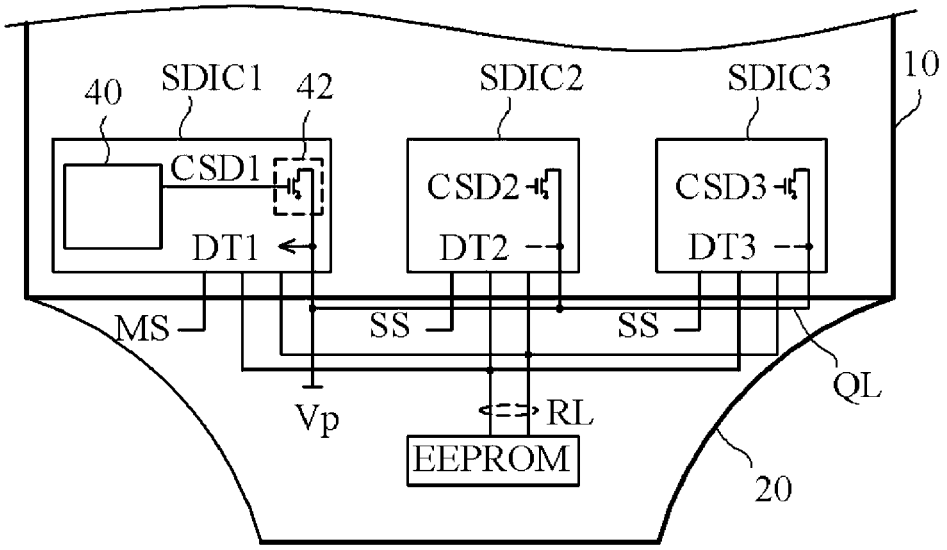
FIG. 7 is a block diagram illustrating a data driving apparatus for a display device in accordance with still another embodiment of the present invention.

The present invention may be embodied in various manners in order to transfer request commands among the drivers SDIC1 to SDIC3. FIG. 7 illustrates such an embodiment.

The data driving apparatus in accordance with the embodiment of FIG. 7 includes the EEPROM as a memory and the drivers SDIC1 to SDIC3. In the embodiment of FIG. 7, a request line QL shared by the drivers SDIC1 to SDIC3 is configured.

Figure 8:
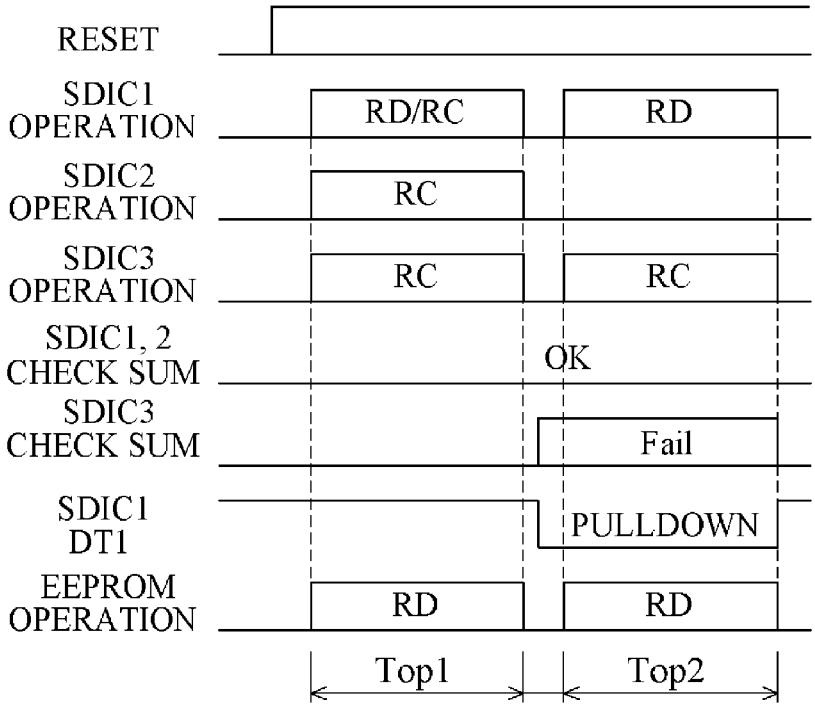
FIG. 8 is a timing diagram for describing an operation of the data driving apparatus in accordance with the embodiment of FIG. 7 when a fail occurred.

Referring to FIGS. 7 and 8, the configuration and operation of the data driving apparatus in accordance with the embodiment of FIG. 7 will be described in detail.

The EEPROM is configured to store operation data and provide the operation data through the routing lines RL in response to a read command.

The driver SDIC1 is set to the master driver according to the option signal MS, coupled to the EEPROM through the routing lines RL, provides a first read command to the EEPROM in the first operation period Top1, and receive the operation data provided in response to the first read command.

The drivers SDIC2 and SDIC3 are set to the slave drivers according to the option signal SS, and configured to share the EEPROM with the driver SDIC1 through the routing lines RL, and receive the operation data shared by the routing lines RL in the first operation period Top1.

The request line QL is shared by the drivers SDIC1 to SDIC3.

The embodiment of FIG. 7 is configured in the same manner as the embodiment of FIG. 5 except that the request command is transferred through the request line QL. Thus, the duplicated descriptions will be omitted herein.

In the above-described configuration, a pull-up voltage VP having a preset level is applied to the request line QL.

Each of the drivers SDIC1 to SDIC3 includes a checksum determination unit 40 and a request driving circuit 42.

In the case of the driver SDIC1, the checksum determination unit 40 may have the same configuration as the checksum determination unit 30 of FIG. 6, and provide a determination signal CSD1 indicating a result obtained by determining a fail of the received operation data. The request driving circuit 42 is configured to generate a request command in response to determination signals CSD1 to CSD3, and drive the request command to the request line QL. For this operation, the request driving circuit 42 may include a switching circuit coupled to the request line to which the pull-up voltage having the preset level is applied, and the switching circuit may be configured as an NMOS transistor which switches coupling the request line to the ground, for example.

According to the above-described configuration, when the checksum determination unit 40 determines a fail of the operation data and provides the high-level determination signal CSD1, the request driving circuit 42 is turned on by the high-level determination signal CSD1, and generates and drives a pull-down voltage as the request command, the pull-down voltage being obtained by pulling down the voltage of the request line QL to the ground voltage level.

At this time, the request command may be understood as the voltage DT1 of a node through which the request line QL is coupled to the request driving circuit 42.

In FIG. 7, each of the drivers SDIC1 to SDIC3 may include the checksum determination unit 40 and the request driving circuit 42, and the request line QL may be coupled to the request driving circuit 42. For convenience of illustration, however, FIG. 7 schematically illustrates that the checksum determination unit 40 and the request driving circuit 42 are configured in the driver SDIC1, and only an NMOS transistor illustrated as the request driving circuit 42 is configured in the drivers SDIC2 and SDIC3.

According to the above-described configuration, the drivers SDIC1 to SDIC3 perform the reset mode in response to power-on of the display device, and require operation data such as a command for the reset mode when a reset signal RESET is enabled.

The request driving circuits 42 of the drivers SDIC1 to SDIC3 maintain a turn-off state at the time of entering the reset mode, and the request line QL retains the level of the pull-up voltage VP.

The driver SDIC1 set to the master driver provides the first read command to the EEPROM through the routing lines RL in the first operation period Top1 in response to the reset mode (RD).

The EEPROM provides the operation data to the routing lines RL in response to the first read command of the driver SDIC1. That is, the operation data are shared by the drivers SDIC1 to SDIC3 through the routing lines RL.

When the operation data are shared through the routing lines RL in the first operation period Top1, the drivers SDIC1 to SDIC3 receive the operation data through the routing lines RL (RC).

The driver SDIC1 receives the operation data corresponding to the first read command, after providing the first read command. However, the drivers SDIC2 and SDIC3 wait for the operation data to be shared through the routing lines RL in the rest mode, and receive the operation data when the operation data are shared through the routing lines RL.

After the first operation period Top1, the drivers SDIC1 to SDIC3 may check whether a fail occurred in the received operation data, through operations of the checksum determination units 40 therein.

When a fail occurred in one or more of the drivers SDIC1 to SDIC3, the checksum determination unit 40 of the driver in which the fail occurred provides the high-level determination signal CSD1, CSD2 or CSD3, and the request driving circuit 42 of the corresponding driver is turned on by the high-level determination signal CSD1, CSD2 or CSD3, and generates and drives a pull-down voltage as the request command, the pull-down voltage being obtained by pulling down the voltage of the request line QL to the ground voltage level.

That is, when a fail occurs in one or more of the drivers SDIC1 to SDIC3, the request command is shared by the request line QL.

The driver SDIC1 receives the request command shared by the request line QL through the voltage DT1, and provides the second command to the EEPROM in response to the request command in the second operation period Top2 following the first operation period Top1.

The EEPROM provides the operation data to the routing lines RL in response to the second read command.

When the operation data are shared through the routing lines RL in the second operation period Top2, the driver in which the fail occurred receives the operation data through the routing lines RL again (RC).

FIG. 8 is based on the supposition that a fail occurred in the driver SDIC3 and the driver SDIC3 receives the operation data again in the second operation period Top2. At this time, the drivers SDIC1 and SDIC2 may be configured to receive the operation data corresponding to the second read command again or ignore the operation data.

The data driving apparatuses in accordance with the embodiments of FIGS. 7 and 8 can provide a configuration and process of simply transferring the request command among the drivers SDIC1 to SDIC3.

Thus, the data driving apparatuses in accordance with the embodiments of FIGS. 7 and 8 can transfer the operation data stored in the EEPROM to the plurality of drivers through a simple process, thereby reducing the time required for transferring the operation data.

Therefore, when the plurality of drivers share the EEPROM serving as a memory through the routing lines, the operation data stored in the EEPROM can be transferred to the plurality of drivers through a simple process.

Furthermore, as the process of transferring the operation data stored in the EEPROM to the plurality of drivers is simplified, it is possible to reduce the time required for transferring the operation data.

While various embodiments have been described above, it will be understood to those skilled in the art that the embodiments described are by way of example only. Accordingly, the disclosure described herein should not be limited based on the described embodiments.

What is claimed is:

1. A data driving apparatus for a display device, comprising:

a memory configured to store operation data, and provide the operation data through a routing line;

a first driver coupled to the memory through the routing line, and configured to provide a first read command to the memory and receive the operation data provided in response to the first read command, in a first operation period;

one or more second drivers configured to share the memory with the first driver through the routing line, and receive the operation data shared through the routing line in response to the first read command, in the first operation period; and a request line shared by the first driver and the one or more second drivers, wherein, after the first operation period, the first driver and the one or more second drivers generate a request command when a fail occurred in the received operation data in response to the first read command in the first operation period, and share the request command with the request line, the first driver provides a second read command to the memory in response to the request command, in a second operation period following the first operation period, and the driver having generated the request command, among the first driver and the one or more second drivers, receives the operation data shared through the routing line in response to the second read command in the second operation period.

2. The data driving apparatus of claim 1, wherein each of the first driver and the one or more second drivers comprises:

a checksum determination unit configured to provide a determination signal indicating a result obtained by determining a fail of the received operation data; and a request driving circuit configured to generate a request command in response to the determination signal, and drive the request command to the request line.

3. The data driving apparatus of claim 2, wherein the request driving circuit comprises a switching circuit coupled to the request line to which a pull-up voltage having a preset level is applied, wherein the switching circuit is turned on in response to the determination signal when a fail occurred in the operation data, and generates and drives a pull-down voltage as the request command, the pull-down voltage being obtained by pulling down a voltage of the request line.

4. The data driving apparatus of claim 3, wherein the first driver receives the operation data corresponding to the second read command again.

5. The data driving apparatus of claim 3, wherein the first request command of the second driver is provided after the first operation period is ended, and in a second operation period following the first operation period, the first driver provides the second read command to the memory, and the second driver receives the operation data corresponding to the second read command.

6. The data driving apparatus of claim 1, wherein the first driver is set to a master driver, and the one or more second drivers are set to slave drivers.

7. A data driving apparatus for a display device, comprising:

a memory configured to store operation data, and provide the operation data through a routing line;

a first driver coupled to the memory through the routing line, and configured to provide a first read command to the memory and receive the operation data provided in response to the first read command, in a first operation period; and a second driver configured to share the memory with the first driver through the routing line, and receive the operation data shared through the routing line in response to the first read command, in the first operation period, wherein, after the first operation period, the second driver provides a first request command to the first driver in a first case that a fail occurred in the operation data received in the first operation period, the first driver provides a second read command to the memory in response to the first request command, in a second operation period following the first operation period, and the second driver receives the operation data, shared through the routing line in response to the second read command, in the second operation period.

8. The data driving apparatus of claim 7, wherein the first and second drivers are mounted on glass of a display panel, and provide source signals corresponding to display data to the display panel, the memory comprises an electrically erasable programmable read-only memory (EEPROM) mounted on a flexible printed circuit board (FPCB) which is electrically coupled to the glass, and the EEPROM is shared by the first and second drivers through the routing line formed by electrical coupling between a first routing line of the glass and a second routing line of the FPCB.

9. The data driving apparatus of claim 7, wherein the first and second drivers perform a reset mode corresponding to power-on, and in the first operation period included in the reset mode, the first driver provides the first read command to the memory, and the first and second drivers receive the operation data shared through the routing line.

10. The data driving apparatus of claim 7, wherein, in the second operation period, the first driver provides the second read command to the memory in response to at least one of a second case that the fail occurred in the operation data received by the first driver and the receiving of the first request command, the second driver receives the operation data corresponding to the second read command in the second operation period, when providing the first request command, and in the second operation period, the first driver receives the operation data corresponding to the second read command in the second case.

11. The data driving apparatus of claim 10, wherein the first and second drivers perform a normal operation of outputting a source signal, after performing a reset mode which corresponds to power-on and includes the first and second operation periods, and perform an operation of providing a read command to the EEPROM again when a fail of the operation data occurs during the normal operation.

12. The data driving apparatus of claim 7, further comprising a third driver configured to share the memory with the first and second drivers through the routing line, and receive the operation data shared by the routing line in the first operation period, Wherein, after the first operation period, the third driver provides a second request command to the second driver in a third case that the fail occurred in the operation data received by the third driver, the second driver provides the first request command corresponding to the second request command, the first driver provides the second read command corresponding to the first request command to the memory, in the second operation period; and the third driver receives the operation data corresponding to the second read command, in the second operation period.

13. The data driving apparatus of claim 12, wherein the second driver comprises:

a checksum determination unit configured to provide a determination signal indicating a result obtained by determining a fail of the received operation data; and a logic circuit configured to perform an OR operation on the second request command and the determination signal, and output the operation result as the first request command.

* * * * *